US012606345B2

(12) United States Patent
Christensen

(10) Patent No.: US 12,606,345 B2
(45) Date of Patent: Apr. 21, 2026

(54) ALU-BOX COMPRISING A PROFILE AND THE PROFILE AS SUCH

(71) Applicant: WIBERG & WIBERG APS, Sorø (DK)

(72) Inventor: Søren Wiberg Christensen, Sorø (DK)

(73) Assignee: WIBERG & WIBERG APS, Soro (DK)

( * ) Notice: Subject to any disclaimer, the term of this patent is extended or adjusted under 35 U.S.C. 154(b) by 24 days.

(21) Appl. No.: 18/035,579

(22) PCT Filed: Nov. 5, 2021

(86) PCT No.: PCT/EP2021/080738

§ 371 (c)(1),
(2) Date: May 5, 2023

(87) PCT Pub. No.: WO2022/096631

PCT Pub. Date: May 12, 2022

(65) Prior Publication Data

US 2023/0391496 A1 Dec. 7, 2023

(30) Foreign Application Priority Data

Nov. 6, 2020 (DK) ..... PA202001260

(51) Int. Cl.

| | |
|---|---|
| ***B65D 6/28*** | (2006.01) |
| ***B21C 23/21*** | (2006.01) |
| ***B65D 6/02*** | (2006.01) |

(52) U.S. Cl.
CPC ..... *B65D 7/34* (2013.01); *B21C 23/21* (2013.01); *B65D 7/06* (2013.01)

(58) Field of Classification Search
CPC ..... B65D 7/12; B65D 7/34
USPC ..... 220/668; 217/65
See application file for complete search history.

(56) References Cited

U.S. PATENT DOCUMENTS 2,578,644 A * 12/1951 Mautner ..... B65D 7/12 206/508
2,767,876 A 10/1956 Mautner

FOREIGN PATENT DOCUMENTS

DE 1957258 U 3/1967
JP H0891369 A 4/1996

* cited by examiner

*Primary Examiner* — Jeffrey R Allen
(74) *Attorney, Agent, or Firm* — Nath, Goldberg & Meyer; Joshua B. Goldberg

(57) ABSTRACT

The present invention relates to a metal-box (14) comprising a metal frame (15), at least one metal wall (13) and at least one metal bottom plate (12), wherein the metal frame (15) comprises a metal profile (1), wherein the metal profile (1) comprising an elongated element (2) and a cross-section (3), wherein the cross-section (3) comprising (i) a cavity (4), and the cavity (4) is enclosed by a first flange (5), a bottom part (6) and a first side (8) of a second flange (7), and (ii) a recess (9) enclosed by a second side (10) of the second flange (7) and the bottom part (6).

9 Claims, 6 Drawing Sheets

ALU-BOX COMPRISING A PROFILE AND THE PROFILE AS SUCH

This is a National Phase Application filed under 35 U.S.C. 371 as a national stage of PCT/EP2021/080738, filed Nov. 5, 2021, an application claiming the benefit of Denmark Application No. PA202001260, filed Nov. 6, 2020, the content of each of which is hereby incorporated by reference in its entirety.

TECHNICAL FIELD OF THE INVENTION

The present invention relates to metal profile. In particular, the present invention relates to a metal profile, preferably provided in aluminium, to be used as a metal frame in building a metal-box in order to securing the metal-box from undesirable movements.

BACKGROUND OF THE INVENTION

Aluminium boxes for storage and transportation have gained increasing popular because use of plastics may cause environmental issues and there is an increasing interest in using other materials than plastic for the sake of the environment and ecosystem.

Furthermore, there is an interest in using materials that are recyclable where e.g. plastic recycling where scrap or waste plastic are recovered and reprocessed into useful plastic products may be a complex and challenging process. Compared with lucrative recycling of metals, plastic polymers recycling is often more challenging because of low density and low value of the plastic products. In addition to this, there are also numerous technical hurdles to overcome when recycling plastic materials.

In particular recycling of plastics comprising different types of plastic materials, which is often the case, recycling is highly problematic because when the different types of plastics are melted together, they tend to phase-separate, like oil and water, and set in these layers. The phase boundaries cause structural weakness in the resulting material, meaning that polymer blends are useful in only limited applications On the other hand, metals are easily recycled, because the metal may be melted and reused in a range of different. The advantage of metal is also that often recycling of metals, such as aluminium is far less expensive and energy-intensive than creating new metal, such as aluminium, which therefore inspires and motivates recycling.

Aluminium boxes for storage and transportation have been known of years and are traditionally made of 100% aluminium and provide a strong, safe and light box for storage and transportation of various things. Aluminium boxes may be sealed with silicone in all joints and a sealing strip may be provided in the lid, which increases strength and keeps dust and water out. The lid may be provided with a lock, which closes easily with brackets, ensuring that the aluminium box does not suddenly and unintentionally open.

The problem with the aluminium boxes available today is that even they are stackable by having a structure of the lid of a first aluminium box that fits into the structure of the bottom plate of a second aluminium box placed on top of the first aluminium box, by using stacking corners, the aluminium boxes tend to easily slide on the surface they are placed.

Aluminium boxes are easily transported and erected anywhere in the world and can withstand even the most extreme conditions. The aluminium boxes are used for transportation of tools, chemicals, electronics, equipment, and food under often rough conditions, e.g. on ships, on the back of a car or a truck, on a bike.

In order to avoid the aluminium boxes to slide on the surface of e.g. the ship, the back of the car or the back, or on the top, of a truck or on the bike during transportation, the aluminium boxes are secured to the surface by tighten a strap around the aluminium boxes and tighten them to the surface.

This is not a preferred way to securing the aluminium box to the surface since it is not always an efficient and reliable way to properly securing the aluminium boxes to the surface.

Hence, an improved aluminium box would be advantageous, and in particular an aluminium box which is easily, efficiently, and reliably secured to a surface would be advantageous.

SUMMARY OF THE INVENTION

Thus, an object of the present invention relates to a newly developed metal frame used for a metal-box, such as an aluminium box, allowing the metal-box to be secured from undesirable movements relative to the surface they are placed.

In particular, it is an object of the present invention to provide a metal box, such as an aluminium box, that solves the above-mentioned problems of the prior art with weight, flexibility, recycling environment and which is easily, efficiently, and reliably secured to a surface.

Thus, one aspect of the invention relates to a metal profile comprising an elongated element and a cross-section, wherein the cross-section comprising:

(i) a cavity, and the cavity is enclosed by a first flange, a bottom part and a first side of a second flange, and (ii) a recess enclosed by a second side of the second flange and the bottom part.

A further aspect fo the present invention relates to a metal profile comprising an elongated element and a cross-section, wherein the cross-section comprising:

(i) a cavity, and the cavity is enclosed by a first flange, a bottom part and a first side of a second flange, and (ii) a recess enclosed by a second side of the second flange and the bottom part, wherein the first flange is curved or partly curved (preferably, curved towards the second flange) and/or wherein the first side of the second flange is curved or partly curved (preferably, curved towards a second side of the second flange).

Another aspect of the present invention relates to a method for producing the metal profile, said method comprises the steps of:

(a) providing a metal block;

(b) adjusting the temperature of the metal block to a set-temperature which is below the melting point of the metal block;

(c) extruding the metal block from step (b) through a die; and obtaining a metal profile according to the present invention, said metal profile comprising:

(i) a cavity, and the cavity is enclosed by a first flange, a bottom part and a first side of a second flange, and (ii) a recess enclosed by a second side of the second flange and the bottom part.

Yet another aspect of the present invention relates to a metal-box comprising a metal frame, at least one metal wall and at least one metal bottom plate, wherein the metal frame comprises a metal profile, wherein the metal profile comprising an elongated element and a cross-section, wherein the cross-section comprising:

(i) a cavity, and the cavity is enclosed by a first flange, a bottom part and a first side of a second flange, and (ii) a recess enclosed by a second side of the second flange and the bottom part.

Still another aspect of the present invention relates to a metal-box comprising a metal frame, at least one metal wall and at least one metal bottom plate, wherein the metal frame comprises the metal profile according to the present invention, wherein the at least one metal wall and the at least one metal bottom plate extends from a cavity (enclosed by a first flange, a bottom part and a first side of a second flange) of the metal profile.

A further aspect of the present invention relates to a coupling system comprising a first part of the coupling system and one or more second part of the coupling system, wherein the first part of the coupling system may comprise the metal box according to the present invention or the metal profile according to the present invention and the one or more second part of the coupling system may comprise one or more brackets.

An additional aspect of the present invention relates to a stand comprising a coupling system, wherein the coupling system comprising a first part of the coupling system and one or more second part of the coupling system, wherein the first part of the coupling system may comprise the metal profile according to the present invention and the one or more second part of the coupling system may comprise one or more brackets.

BRIEF DESCRIPTION OF THE FIGURES

The presence of the protrusion (11) creates together with the second side (10) of the second flange (7) and a bottom part (6) a recess, in particular a one-side open recess.

Figure 1:
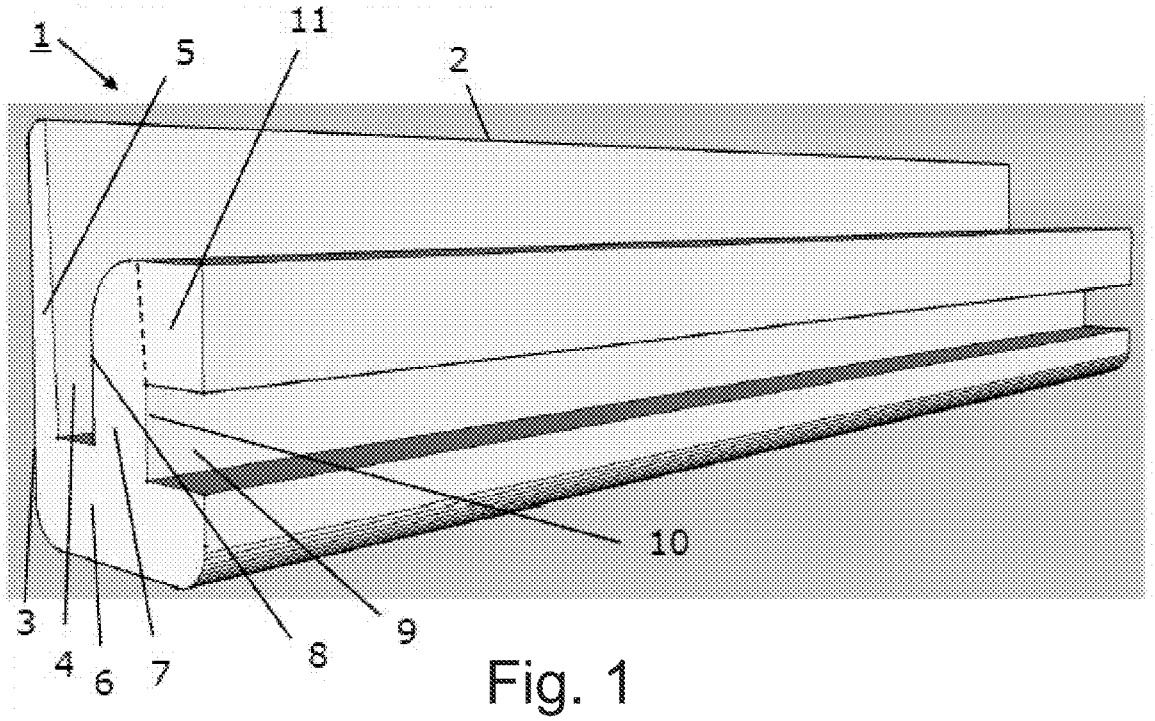
FIG. 1 shows a metal profile (1) comprising an elongated element (2) and a cross-section (3), wherein the cross-section (3) comprising (i) a cavity (4), and the cavity (4) is enclosed by a first flange (5), in particular a straight first flange (5), a bottom part (6) and a first side (8) of a second flange (7), and (ii) a recess (9) enclosed by a second side (10) of the second flange (7) and the bottom part (6). The metal profile provided in FIG. 1 also comprises a protrusion (11) extending from a second side (10) of a second flange (7).
Figure 2:
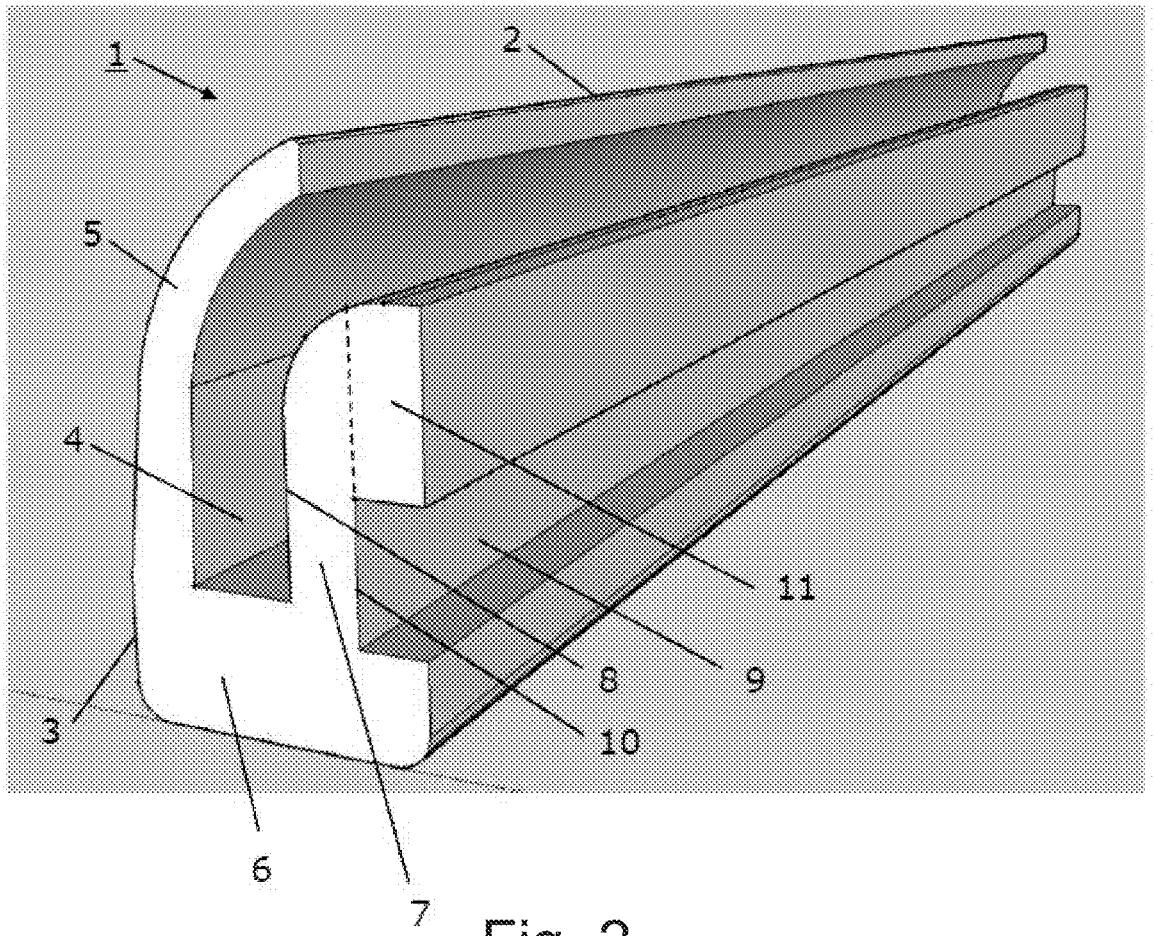
FIG. 2 shows a metal profile (1) comprising an elongated element (2) and a cross-section (3), wherein the cross-section (3) comprising (i) a cavity (4), and the cavity (4) is enclosed by a first flange (5), in particular a first flange (5) having an upper curved part (which upper curved part may be provided after a metal bottom plate (not shown) and a metal wall (not shown) have been introduced and secured into the cavity). The cavity (4) is further enclosed by a bottom part (6) and a first side (8) of a second flange (7), and (ii) a recess (9) enclosed by a second side (10) of the second flange (7) and the bottom part (6). The metal profile provided in FIG. 1 also comprises a protrusion (11) extending from a second side (10) of a second flange (7). The presence of the protrusion (11) creates together with the second side (10) of the second flange (7) and a bottom part (6) a recess, in particular a one-side open recess.
Figure 3:
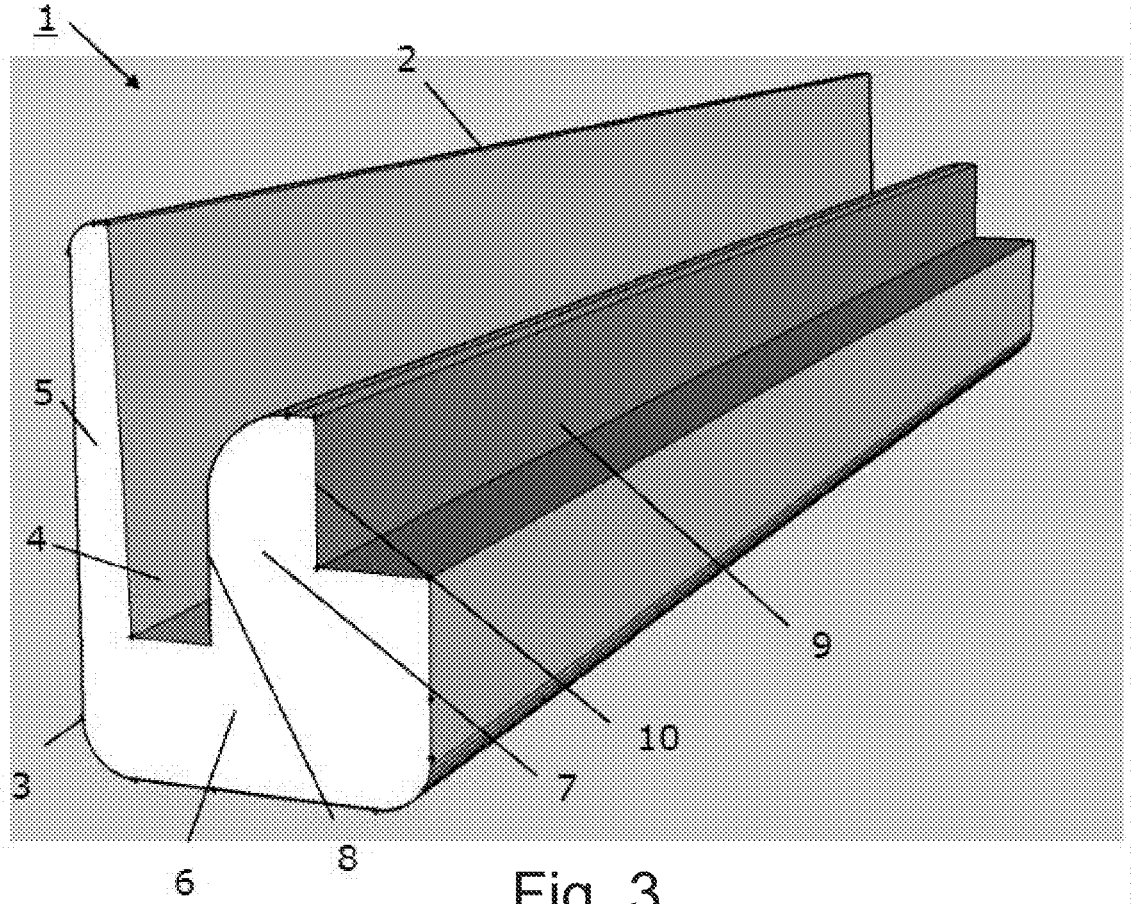
FIG. 3 shows a metal profile (1) comprising an elongated element (2) and a cross-section (3), wherein the cross-section (3) comprising (i) a cavity (4), and the cavity (4) is enclosed by a first flange (5), in particular a straight first flange (5), a bottom part (6) and a first side (8) of a second flange (7), and (ii) a recess (9) enclosed by a second side (10) of the second flange (7) and the bottom part (6). The metal profile of FIG. 2 comprises a two-side open recess (9) formed from the second side (10) of the second flange (7) and the bottom part (6)
Figure 4:
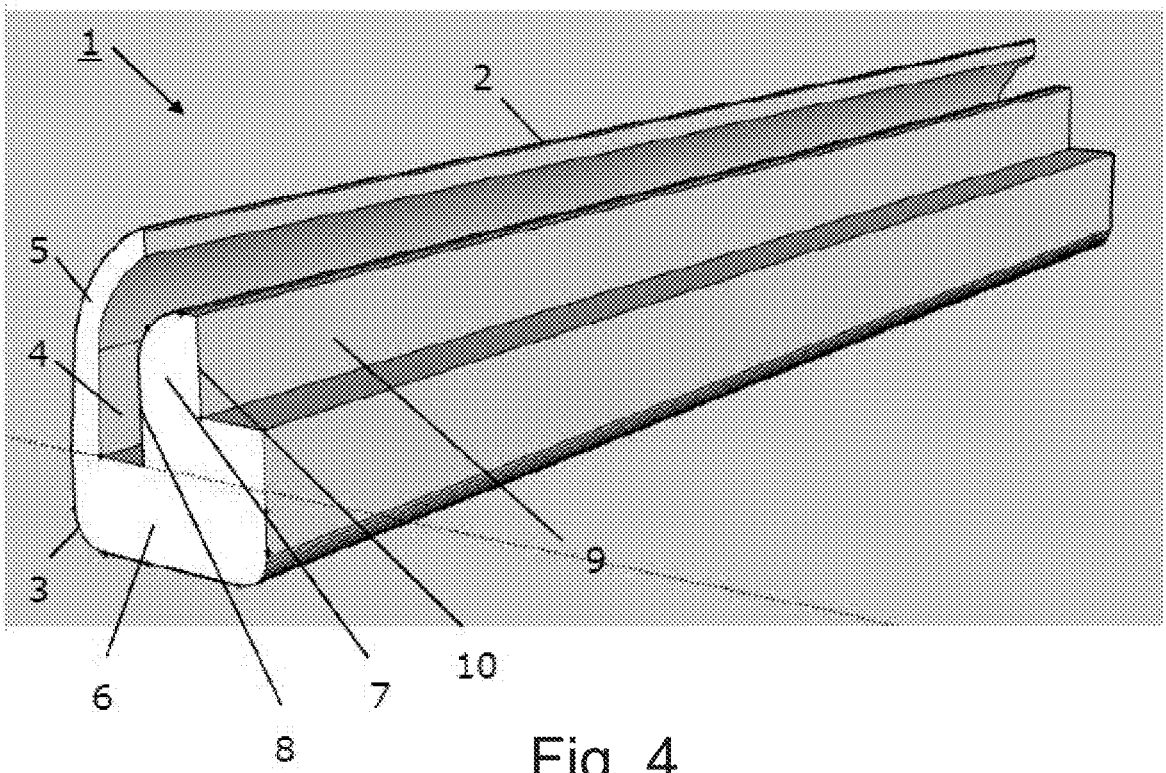
FIG. 4 shows a metal profile (1) comprising an elongated element (2) and a cross-section (3), wherein the cross-section (3) comprising (i) a cavity (4), and the cavity (4) is enclosed by a first flange (5), in particular a first flange (5) having an upper curved part (which upper curved part may be provided after a metal bottom plate (not shown) and a metal wall (not shown) have been introduced and secured into the cavity). The cavity (4) is further enclosed by a bottom part (6) and a first side (8) of a second flange (7), and (ii) a recess (9) enclosed by a second side (10) of the second flange (7) and the bottom part (6). The metal profile of FIG. 2 comprises a two-side open recess (9) formed from the second side (10) of the second flange (7) and the bottom part (6)
Figure 5:
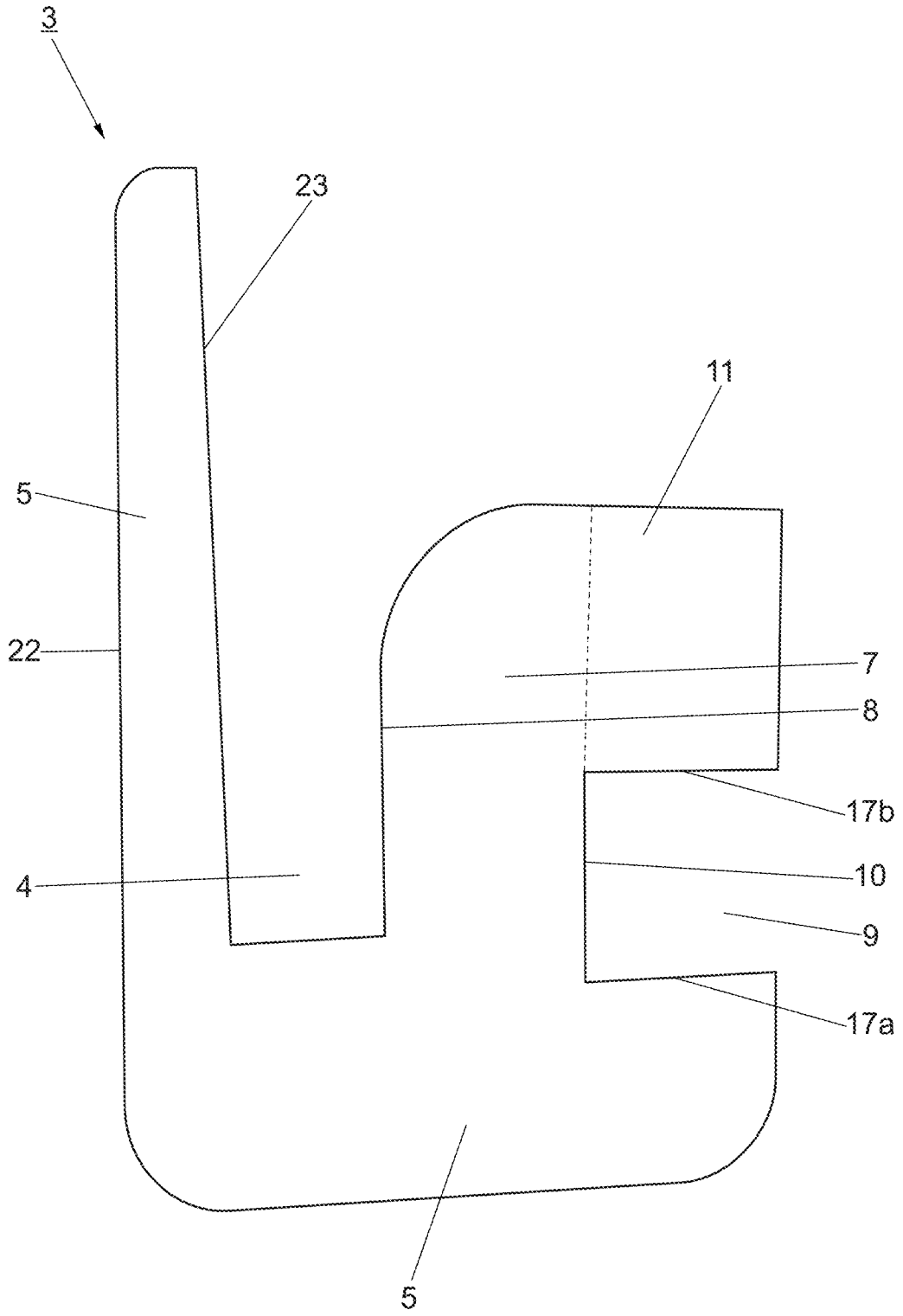
FIG. 5 shows a cross-section (3) of the metal profile according to the precent invention. The cross-section (3) comprising (i) a cavity (4), and the cavity (4) is enclosed by a first flange (5), in particular a straight first flange (5), a bottom part (6) and a first side (8) of a second flange (7), and (ii) a recess (9) enclosed by a second side (10) of the second flange (7) and the bottom part (6). The dashed line in FIG. 3 indicates the presence (as shown in FIG. 1) or the absence (as shown in FIG. 2) of a protrusion (11) extending from a second side (10) of a second flange (7). The presence of the protrusion (11) creates together with the second side (10) of the second flange (7) and a bottom part (6) a recess, in particular a one-side open recess, whereas the absence of a protrusion (11) creates a two-side open recess (9) formed from the second side (10) of the second flange (7) and the bottom part (6)
Figure 6:
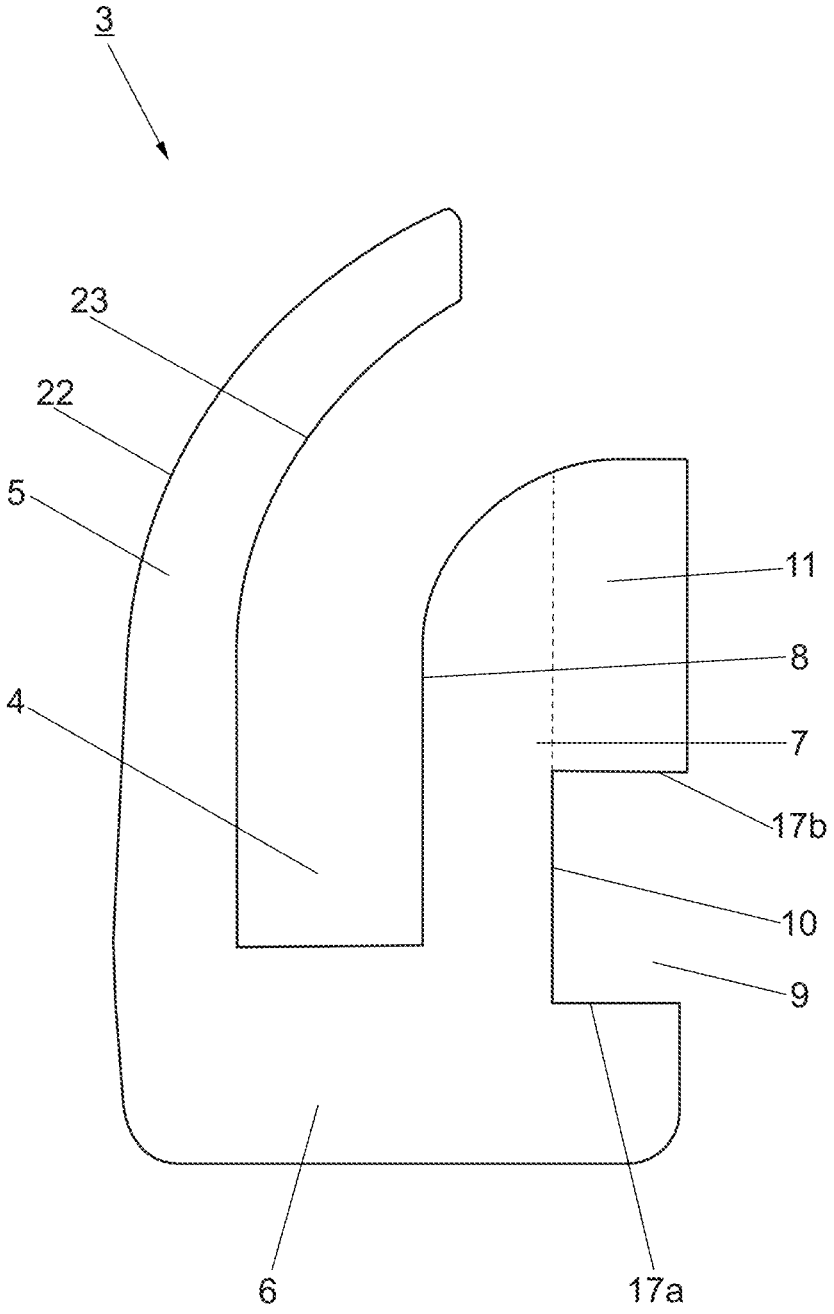
FIG. 6 shows a cross-section (3) of the metal profile according to the precent invention. The cross-section (3) comprising (i) a cavity (4), and the cavity (4) is enclosed by a first flange (5), in particular a first flange (5) having an upper curved part (which upper curved part may be provided after a metal bottom plate (not shown) and a metal wall (not shown) have been introduced and secured into the cavity). The cavity (4) is further enclosed by a bottom part (6) and a first side (8) of a second flange (7), and (ii) a recess (9) enclosed by a second side (10) of the second flange (7) and the bottom part (6). The dashed line in FIG. 3 indicates the presence (as shown in FIG. 1) or the absence (as shown in FIG. 2) of a protrusion (11) extending from a second side (10) of a second flange (7). The presence of the protrusion (11) creates together with the second side (10) of the second flange (7) and a bottom part (6) a recess, in particular a one-side open recess (9), whereas the absence of a protrusion (11) creates a two-side open recess (9) formed from the second side (10) of the second flange (7) and the bottom part (6). The recess (9) of the metal profile (1) comprises the second side (10) of the second flange (7) and a bottom edge (17*a*), and when the recess (9) may be a one-side open recess (9) the metal profile (1) also comprises a top edge (17*b*). The second side (10) of the second flange (7) and a bottom edge (17*a*), and optionally the top edge (17*b*), forms the opening (18) of the recess (9).
Figure 7A:
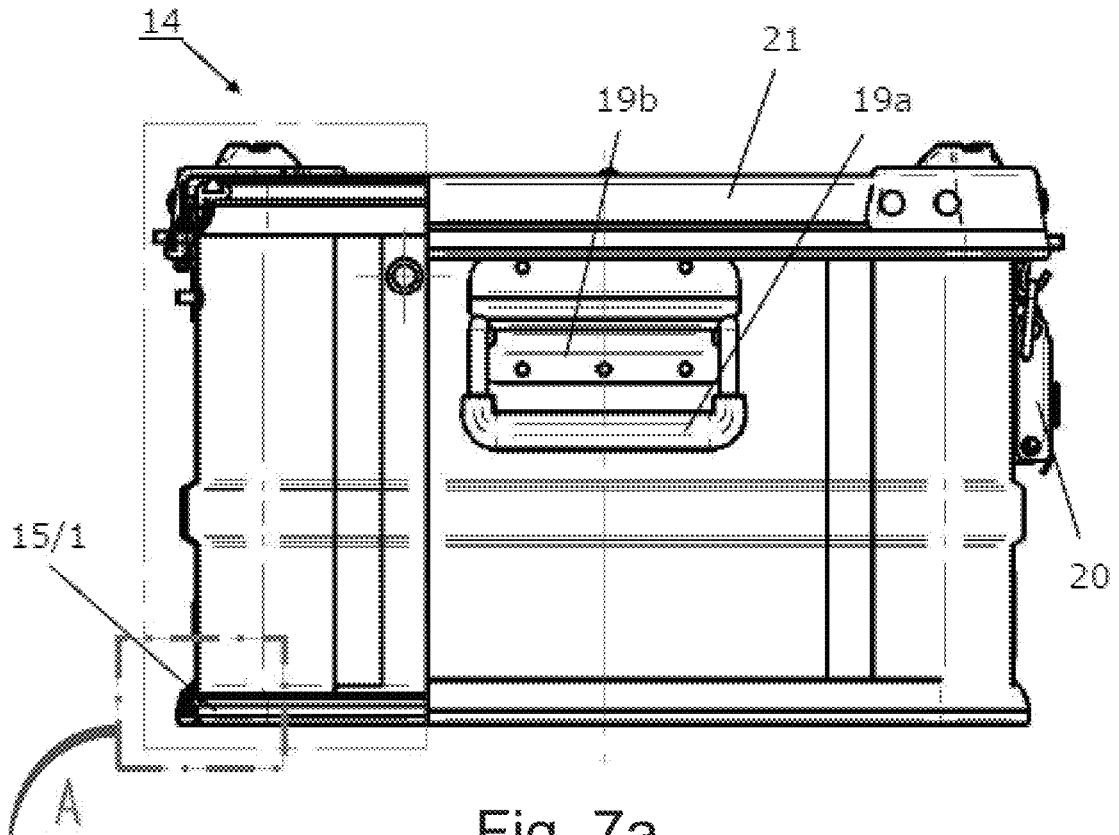
FIG. 7*a* shows a metal box (14), an aluminium box comprising a handle (19*a*) comprising a mounting plate (19*b*), a lock (20) to close the lid (21); and a metal frame (15) comprising the metal profile (1) according to the present invention. A section of the lower left corner of FIG. 7*a* has been provided in FIG. 7*b*.
Figure 7B:
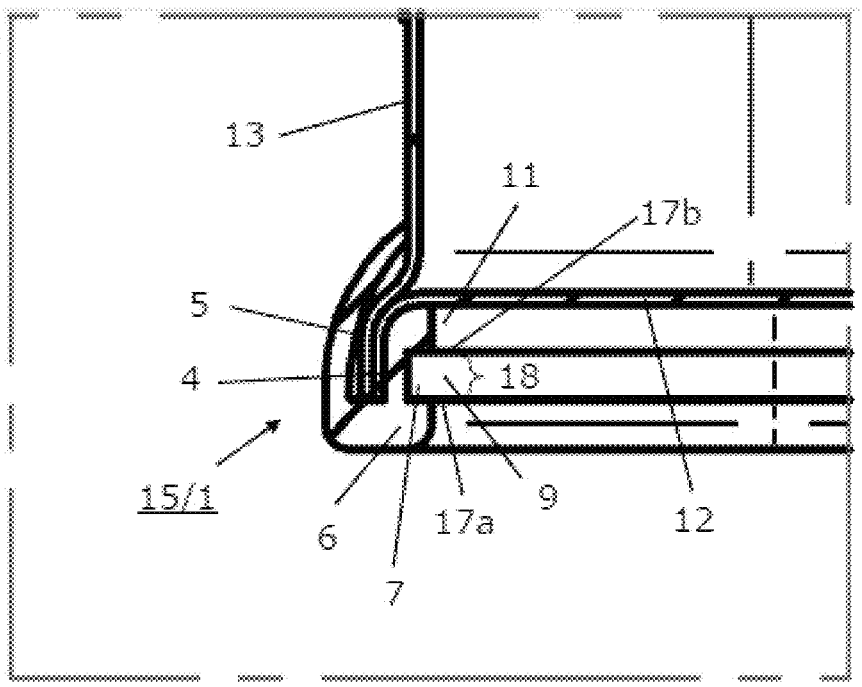
FIG. 7*b* shows a section view of the metal box (14) of FIG. 7*a* and shows the cross-section (3) of the metal frame (15)/metal profile (1). The cross-section (3) comprising (i) a cavity (4), and the cavity (4) is enclosed by a first flange (5), a bottom part (6) and a first' side (8) of a second flange (7), and (ii) a recess (9) enclosed by a second side (10) of the second flange (7) and the bottom part (6). The dashed line following the second flange from the bottom part and upwards indicates a protrusion (11) extending from a second side (10) of a second flange (7). The first flange (5) comprises a first side (22) of the first flange (5) and a second side (23) of the first flange (5). The presence of the protrusion (11) creates together with the second side (10) of the second flange (7) and a bottom part (6) a recess (9), in particular a one-side open recess (9) as shown in FIG. 1, whereas the absence of a protrusion (11) creates a two-side open recess (9) formed from the second side (10) of the second flange (7) and the bottom part (6) and as shown in FIG. 2.
Figure 8:
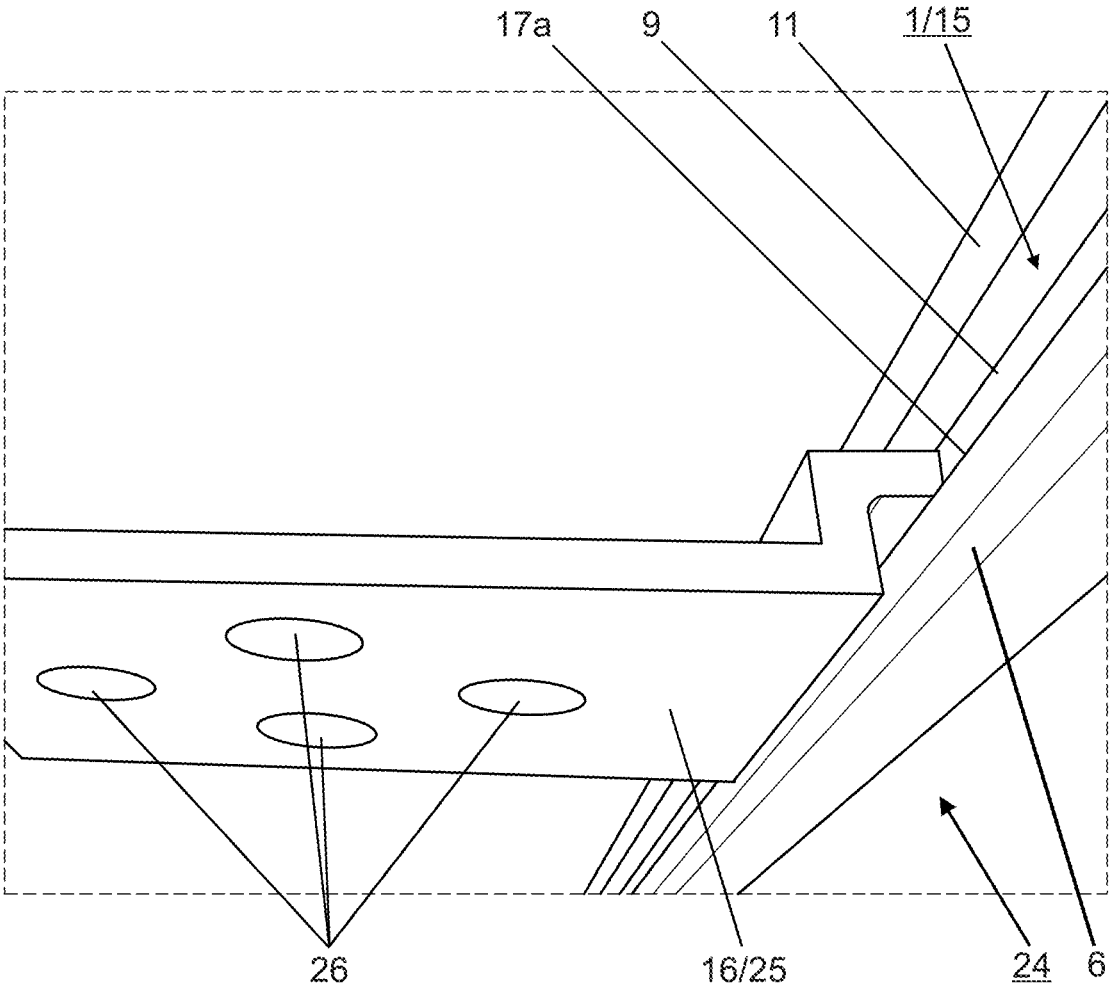
FIG. 8 shows a coupling system (24) comprising a first part of a coupling system capable of coupling with one second part (16). The first part in FIG. 8 of the coupling system is a metal profile (1) (or the metal frame (15)) forming part of a metal box from which a metal bottom plate (12) is shown. The coupling system may comprise two or more second parts (16) distributed along the metal profile (1) or the metal frame (15). The second part of the coupling system of FIG. 8 may be a bracket (25). The metal profile (1) (or the metal frame (15)) is provided with a bottom part (6), a recess (9) and a protrusion (11) extending from a second flange. The bracket (25) is engaging with the recess (9) of the metal frame (15)/metal profile (1), such as the aluminium frame/profile. In particular, the bracket (25) is engaging with a bottom edge (17*a*) of the recess (9). The bracket (25) comprises 4 mounting holes (26) for securing the bracket (25), which when engaging with the recess (9) secures the metal box.

The present invention will now be described in more detail in the following.

DETAILED DESCRIPTION OF THE INVENTION

Traditionally metal box comprises a metal profile which is placed in the bottom of the metal box collecting the metal bottom plate and the metal wall. Henges are provided on the metal wall in one end and a lid in the other end. The metal boxes are also often provided with a lock to close the lid and handles to carry the boxes. No means are provided to securing the metal boxes to a surface (different from another metal box, often a metal box of the same brand, size and model) on which the metal box is placed during storage and/or transportation.

The inventor of the present invention found that no proper securing system existed for securing metal boxes to a surface to avoid unintentional and undesirable movements of the metal box relative to the surface.

Accordingly, a preferred embodiment of the present invention relates to a metal profile comprising an elongated element and a cross-section, wherein the cross-section comprising:

(i) a cavity, and the cavity is enclosed by a first flange, a bottom part and a first side of a second flange, and (ii) a recess enclosed by a second side of the second flange and the bottom part.

The metal profile may comprise a cross-section having a cross-sectional view comprising the cavity; the first flange; the bottom part; the second flange; and the recess of the metal profile.

In the context of the present invention the term "cross-sectional view" relates to a cross-sectional view of the metal profile, and in particular a perpendicular cross-sectional view relative to the longitudinal direction of the metal profile.

The first flange may be extending from the bottom part. The second flange may be extending from the bottom part. Both the first flange and the second flange may be extending from the bottom part; preferably the first flange and the second flange may be extending from the bottom part and may be extending in the same direction from the bottom part In an embodiment of the present invention the metal profile may be provided from a metal material.

Preferably, the metal material may be aluminium, an alloy or an aluminium alloy.

In the present context the terms "aluminium" and "aluminium alloy" may be used interchangeably and relates to a metal comprising at least 80% pure aluminium; e.g. 90% pure aluminium; such as 95% pure aluminium; e.g. 98% pure aluminium; such as 100% pure aluminium. The content of aluminium may not include naturally occurring impurities.

In an embodiment of the present invention the aluminium may be a high-grade aluminium. Preferably, high grade aluminium comprises at least 95% pure aluminium; e.g. at least 98% pure aluminium; such as at least 99% pure aluminium Aluminium alloys may comprise at most 10% other metal or at most 10% of a combination of other metals; such as at most 8%; e.g. at most 6%; such as at most 4%; e.g. at most 2%; such as at most 1%; e.g. at most 0.5%.

In the context of the present invention the term "%" is based on a weight by weight (w/w) basis, unless stated otherwise.

The metal profile according to the present invention may comprise a cavity, which cavity may be enclosed by a first flange, a bottom part and a second flange, in particular a first side of a second flange. The cavity may be continued through the entire length of the elongated element. Preferably, the cavity may be continued through the entire length of the elongated element from the cross-section along the elongated element.

In the context of the present invention the term "elongated element" relates to the 3-dimentional structure provided by the metal profile, extending perpendicular out from the cross-section of the metal profile.

The cavity may preferably be provided for receiving two or more metal plates (preferably aluminium plates) to be combined. The two or more metal plates may be combined by pressing or squeezing the first flange and the second flange around the metal plates, or by welding the two or more metal plates to the metal profile or by the combination of pressing/squeezing and welding.

Preferably, the cavity may be provided for receiving two metal plates (preferably aluminium plates) to be combined.

The pressing or squeezing the first flange towards the second flange around the metal plates may create a curved or a partly curved first flange as described herein.

In an embodiment of the present invention the recess may be continued through the entire length of the elongated element. Preferably, the recess may be continued through the entire length of the elongated element from the cross-section along the elongated element.

Additionally, the first flange may be continued through the entire length of the elongated element. The first profile may preferably be continued through the entire length of the elongated element from the cross-section along the elongated element.

The second flange may be continued through the entire length of the elongated element. The second profile may preferably be continued through the entire length of the elongated element from the cross-section along the elongated element.

The bottom part may be continued through the entire length of the elongated element. The bottom part may preferably be continued through the entire length of the elongated element from the cross-section along the elongated element.

In an embodiment of the present invention, the recess may be provided as a single recess throughout the entire length of the elongated element.

In yet an embodiment of the present invention the recess may be provided as one or more separated gaps placed in the metal profile, such as 2 or more gaps, e.g. 3 or more gaps, such as 4 or more gaps, e.g. 5 or more gaps, such as 6 or more gaps, e.g. 7 or more gaps, such as 8 or more gaps.

The first flange of the metal profile may be a straight first flange (or a substantially straight), a curved first flange or a partly curved first flange.

A partly curved first flange may be a flange which may be straight (or substantially straight) in a first part of the length of the first flange and curved in a second part of the flange.

When the first flange is a partly curved flange wherein the curved part may be in the end of the flange, opposite to bottom part. The partly curved flange may be curved in 10-90% of the length of the curved flange, such as 20-80%, e.g. 30-70, such as 40-60%, e.g. about 50% of the first flange may be curved.

The curved part of the first flange may improve usage of the metal profile, in particular when used for producing a metal-box where insertion and forming of at least one metal wall and at least one metal bottom plate into the cavity is necessary.

In an embodiment of the present invention the first flange may be provided with a first side of the first flange and a second side of the first flange.

In a further embodiment of the present invention the first side of the first flange and the second side of the first flange may be equally directed (straight and/or curved).

In the present invention the term "equally directed" may relate to the two sides of the first flange (the first side of the first flange and the second side of the first flange) which may be equally separated from each other, or substantially equally separated from each other, causing the width of the first flange may be the same, or substantially the same, throughout the length of the first flange.

In an embodiment of the present invention the curved first flange or the partly curved first flange is curved in the direction towards the second flange.

In a further embodiment of the present invention the first side of the second flange may be a curved first side of the second flange or a partly curved first side of the second flange.

The first side of the second flange may be curved in a first part, preferably the first part may be an upper part of the second flange (the part opposite to the bottom part).

In an embodiment of the present invention part of the first part of the second flange may be curved or partly curved in the end of the flange, opposite to bottom part. The partly curved first side of the second flange may be curved in 10-90% of the length of the second flange, such as 20-80%, e.g. 30-70, such as 40-60%, e.g. about 50% of the first side of the second flange may be curved.

As with the curved part of the first flange, the curved part of the first side of the second flange may improve usage of the metal profile, in particular when used for producing a metal-box where insertion and forming of at least one metal wall and at least one metal bottom plate into the cavity is necessary.

In an embodiment of the present invention the first flange may be curved or partly curved (preferably, curved towards the second flange) and/or wherein the first side of the second flange may be curved or partly curved (preferably, curved towards a second side of the second flange).

In an embodiment of the present invention the distance between the first flange (in particular the first side of the first flange) and the first side of the second flange may be constant or substantially constant through the cavity.

In a further embodiment of the present invention the cavity formed by the first flange, the bottom part and the second flange, may be V-shaped relative to the bottom part, with the peak of the V-shape at the bottom part.

The peak of the V-shape may provide a close contact at the bottom part or a broad contact at the bottom part. This may be illustrated by a short or longer distance between the first flange and the second flange at the bottom part. The short or longer distance may be defined by going from a common contact point between the first flange; the second flange and the bottom part, to a distance between the first flange and the second flange, at the bottom part, that is substantially the same throughout the cavity form the bottom part to the exit/entry of the cavity.

In an embodiment of the present invention the second side of the second flange may form a two-side open recess. The two-side open recess according to the present invention may be provided from the second side of the second flange and the bottom part.

The second side of the second flange may also be provided with a protrusion.

In an embodiment of the present invention the second side of the second flange, the bottom part and the protrusion may form a one-side open recess.

The one-side open recess according to the present invention may be provided from the second side of the second flange, the bottom part, and the protrusion.

The protrusion may be provided in the top of the second side of the second flange. Preferably the protrusion may be continued through the entire length of the elongated element. Preferably, the protrusion may be continued through the entire length of the elongated element from the cross-section along the elongated element.

The protrusion and the bottom part may be extend equally, or substantially equally, from the second side of the second flange (relative to the cross-sectional view).

The protrusion may be added to provide strength to the metal profile, relative to a metal profile without the protrusion.

In an embodiment of the present invention, the top of the second flange, including the protrusion, may be wider than the remaining part of the second flange, excluding the protrusion (relative to the cross-sectional view). Preferably the top of the second flange (including the protrusion) is at least 10% wider (relative to the cross-sectional view); such as at least 25% wider; e.g. at least 50% wider; such as at least 75% wider; e.g. at least 100% wider.

The protrusion may extend in the range of 0.5-30 mm from the second side of the second flange; such as in the range of 0.75-20 mm; e.g. in the range of 1-10 mm; such as in the range of 1.5-5 mm; e.g. in the range of 1.75-2.5 mm such as about 2 mm.

The protrusion may have a hight in the range of 0.5-10 mm from the recess to the top of the second flange; such as in the range of 0.75-8 mm; e.g. in the range of 1-6 mm; such as in the range of 1.5-4 mm; e.g. in the range of 1.75-3 mm such as about 2 mm The hight of the protrusion according to the present invention, may be a distance extending from the recess to the top of the second flange.

In an embodiment of the present invention the second flange may be a straight, or substantially straight, second flange.

The first flange and the second flange may have substantially the same width. In an embodiment of the present invention the width of the first flange and/or the second flange may be individually or commonly selected in the range of 0.5-30 mm from a cross-sectional view of the elongated element; such as in the range of 0.75-20 mm; e.g. in the range of 1-10 mm; such as in the range of 1.5-5 mm; e.g. in the range of 1.75-2.5 mm such as about 2 mm.

The recess may have a distance between the bottom part and the protrusion (providing a recess opening) which is in the range of 0.5-30 mm; such as in the range of 0.75-20 mm; e.g. in the range of 1-10 mm; such as in the range of 2-8 mm; e.g. in the range of 3-6 mm; such as about 4 mm The bottom part may have a width (relative to the cross sectional view of the elongated element) which is at least 1.5 times a width of the combination of the first flange and the second flange (relative to the cross sectional view of the elongated element), such as at least 1.75 times; e.g. at least 2 times; such as at least 2.5 times, such as at least 3 times. In another embodiment of the present invention the bottom part may have a width (relative to the cross sectional view of the elongated element) which is at most 8 times the width of the combination of the first flange and the second flange (relative to the cross sectional view of the elongated element), such as at most 7 times; e.g. at most 6 times; such as at most 5 times, such as at most 4 times; e.g. at most 3.5 times.

In an embodiment of the present invention the first flange is higher than the second flange (relative to the cross-sectional view). Preferably, the first flange is in the range of 10-90% higher than the second flange; such as in the range of 15-80% higher; e.g. in the range of 20-70%; such as in the range of 25-60% higher; e.g. in the range of 30-50%; such as in the range of 35-45% higher.

The first flange may be higher than the second flange and the hight of the first flange relative to the first flange (relative to the second flange) may be determined by the width of the bottom part. This relation between the hight of the first flange and the width of the bottom part (relative to the cross-sectional view) ensures that the first flange does not goes beyond the second side of the second flange or goes beyond the protrusion of the second flange when closing the entry into the cavity, e.g. by pressing or squeezing the first profile, e.g. when using the metal profile, such as an aluminium profile for building a metal box, such as an aluminium box.

In a further embodiment of the present invention the hight of the first flange may be set from the hight of the second flange plus (+) 10-90% of the width of the bottom part (relative to the cross-sectional view); such as plus (+) 20-80% of the width of the bottom part; e.g. plus (+) 30-70% of the width of the bottom part; such as plus (+) 40-60% of the width of the bottom part; e.g. plus (+) 45-55% of the width of the bottom part.

The bottom part may have a width (relative to the cross-sectional view) which is a combination of the width of the first flange (relative to the cross-sectional view), the width of the cavity (relative to the cross-sectional view), the width of the second flange (relative to the cross-sectional view) and the width of the recess (relative to the cross-sectional view).

Preferably, the cavity may be provided for clamping two or more metal plates (such as aluminium plates) to together.

In an embodiment of the present invention the cavity provided for receiving the two or more metal plates (such as aluminium plates) comprises a metal bottom plate and at least one metal wall.

In a further embodiment of the present invention the metal profile may form a first part of a coupling system capable of coupling with one or more second parts of the coupling system.

In an embodiment of the present invention the second part of the coupling system may be engaging with the recess of the metal frame/metal profile, such as the aluminium frame/profile. Preferably, the second part of the coupling system may be engaging with the bottom edge of the recess.

In an embodiment of the present invention the second part of the coupling system may be a bracket.

A preferred embodiment of the present invention relates to a coupling system comprising a first part of the coupling system and one or more second part of the coupling system, wherein the first part of the coupling system may comprise the metal profile according to the present invention or the metal-box according to the present invention and the one or more second part of the coupling system may comprise one or more brackets.

When the one or more brackets may be engaging with the recess of the metal profile, such as the aluminium profile, the metal profile may be fixed, ensuring it is immovable relative to the subject it is fixed to In an embodiment of the present invention the first part of the coupling system may comprise a metal profile having a recess, and the recess may be capable of coupling with several second parts of the coupling system.

The coupling system according to the present invention may comprise a first part of the coupling system and a second part of the coupling system. The first part of the coupling system and said second part of the coupling system may be capable of being fixed together.

In the present context the terms "fixed" and "fixed together" relate to making the first part of the coupling system immovable relative to the second part of the coupling system. Preferably, the second part of the coupling system is fixed to a subject.

In an embodiment of the present invention the subject may be selected from the group consisting of a metal box, an aluminium-box, a stand, a car; a bike, a boat. The stand may be a stand suitable for being attached to a trailer tow or a car; or to the roof racks of a car.

The first part of the coupling system may preferably be releasable fixed to the second part of the coupling system. Preferably, the second part of the coupling system may be fixed to the subject.

In the present invention the term "releasable fixed" relates to the first part of the coupling system and the second part of the coupling system being repeatedly fixed together and released from each other.

The coupling system may comprise a single first part of the coupling system (e.g. metal profile comprising a recess continued through the entire length of the elongated element, e.g. from the cross-section along the elongated element) or multiple gaps, such as 2 or more gaps, e.g. 3 or more gaps, such as 4 or more gaps, e.g. 5 or more gaps, such as 6 or more gaps, e.g. 7 or more gaps, such as 8 or more gaps along the length of the elongated element.

In an embodiment of the present invention the first part of the coupling system may comprise a metal profile comprising a recess along the entire elongated element, or one or more gaps provided in the metal profiles along the elongated element, according to the present invention. The first part of the coupling system (comprising the recess, or the one or more gaps provided in the elongated element) may engage with the second part of the coupling system, e.g. the bracket.

In a further embodiment of the present invention the second part of the coupling system may be a bracket fixed to the subject and capable of engaging with the first part of the coupling system. Preferably, the second part of the coupling system may be capable of interacting with the recess of the first part of the coupling system, or with one or more gaps of the first part of the coupling system.

The coupling system may comprise one or more second part of the coupling system, such as 2 or more second part of the coupling system, e.g. 3 or more second part of the coupling system, such as 4 or more second part of the coupling system, e.g. 5 or more second part of the coupling system, such as 6 or more second part of the coupling system, e.g. 7 or more second part of the coupling system, such as 8 or more second part of the coupling system.

In particular, the coupling system comprises a single first part of the coupling system (e.g. provided in the form of a recess continued through the entire length of the elongated element in combination with 1 or more second part of the coupling system, such as 2 or more second part of the coupling system, e.g. 3 or more second part of the coupling system, such as 4 or more second part of the coupling system, e.g. 5 or more second part of the coupling system, such as 6 or more second part of the coupling system, e.g. 7 or more second part of the coupling system, such as 8 or more second part of the coupling system.

The number of second part of the coupling system provided may depend on the use of the elongated element.

The metal-profile may be provided in different ways. Extrusion of the metal profile may however be preferred.

The metal profile, in particular an aluminium profile, according to the present invention may be extruded through a die resulting in an aluminium profile according to the present invention. The extrusion process may involve the following steps:

1. An aluminium block may be provided and heated to approximately 350-600° C.;
2. After the aluminium block reaches the desired temperature, it may be transferred to the loader where a thin film of smut or lubricant may be added to the aluminium block and to a ram. The smut may act as a parting agent (lubricant) which keeps the two parts from sticking together;
3. The aluminium block may be transferred to a cradle of an extruder.
4. The ram may apply pressure to a dummy block which, in turn, pushes the aluminium block until it is inside the container of the extruder.
5. Under pressure the aluminium block may be crushed against the die. The aluminium block may become shorter and wider until it has full contact with the container walls;
6. As a result of the pressure added to the billet, the soft but solid metal begins to squeeze through the die opening and the aluminium profile may be formed;
7. The temperature of the aluminium profile when it exits the press, the exit temperature may be measured. The main purpose of determining this exit temperature is to maintain maximum press speeds wherein the target exit temperature for an extrusion is dependent upon the metal or the alloy to be extruded.
8. Aluminium profiles that exit the die, or are pushed out of the die, may be cooled, e.g. by a series of fans along the entire length of the aluminium profile or other means of cooling.
9. The cooled aluminium profiles may be further treated by heat-treating or artificial aging which may hardens the metal by speeding the aging process in a controlled temperature environment for a set amount of time.

A preferred embodiment of the present invention relates to a method for producing the metal profile, said method comprises the steps of:

(a) providing a metal block;
(b) adjusting the temperature of the metal block to a set-temperature which is below the melting point of the metal block;
(c) extruding the metal block from step (b) through a die; and obtaining a metal profile according to claim 1, wherein said metal profile comprising an elongated element and a cross-section, wherein the cross-section comprises:
  (i) a cavity, and the cavity is enclosed by a first flange, a bottom part and a first side of a second flange, and
  (ii) a recess enclosed by a second side of the second flange and the bottom part.

In an embodiment of the present invention the extrusion in step (c) may be a cold extrusion process.

The set-temperature of the cold extrusion process according to the present invention may be in the range of 10-75° C., such as in the range of 15-50° C., e.g. in the range of 20-30° C.

In another embodiment of the present invention the extrusion in step (c) may be a warm extrusion process. A warm extrusion process may be preferred.

The set-temperature of the warm extrusion process according to the present invention may be above 100° C., but below the melting point of the metal block; such as above 150° C., but below the melting point of the metal block; e.g. above 200° C., but below the melting point of the metal block.

In an embodiment of the present invention the metal material may be aluminium as defined above, and the metal block may be an aluminium block.

Preferably, the warm extrusion may be performed at a temperature in the range of 200-1500° C.; such as in the range of 225-1200° C.; e.g. in the range of 250-1000° C.; such as in the range of 275-800° C.; e.g. in the range of 300-600° C.; such as in the range of 350-500° C.

A preferred embodiment relates to the use of the metal profile according to the present invention as a metal frame in a metal-box.

A further preferred embodiment of the present invention relates to a metal-box comprising a metal frame, at least one metal wall and at least one metal bottom plate, wherein the metal frame comprises the metal profile according to the present invention.

It is preferred that the metal frame and the at least one metal wall and/or the at least one metal bottom plate may be made from the same metal material.

In an embodiment of the present invention the metal frame may be a one-piece metal frame.

When the metal frame is a one-piece metal frame a first end of the metal profile, such as the aluminium profile may be connected to a second end of the metal profile providing the metal frame, such as an aluminium frame.

In a further embodiment of the present invention the metal wall may be a one-piece metal wall.

When the metal wall is a one-piece metal wall, the metal wall may be modulated and/or bend into the desired shape of the bottom part of the metal-box and fixed in the metal frame. The metal frame may be determining the shape of the metal wall.

In yet an embodiment of the present invention the metal bottom plate may be a one-piece metal bottom plate.

When the metal bottom plate is a one-piece metal bottom plate, the metal bottom plate may be modulated and/or cut into the desired shape and fixed in the metal frame. The metal frame may be determining the shape.

The second part of a coupling system, such as a bracket, may be engaging with a recess of the metal frame, preferably, the second part of the coupling system may be engaging with the bottom edge of the recess.

In an embodiment of the present invention the second part of the coupling system, may comprise an engagement section being in contact with the metal profile or the metal frame and a mounting section securing the metal profile or the metal frame to a surface.

In an embodiment of the present invention the metal wall and the metal bottom plate may be combined in the cavity of the metal profile resulting in the metal box. The metal wall and the metal bottom plate may be locked together by closing the cavity around the metal wall and the metal bottom plate, preferably around the rim of the metal wall and the metal bottom plate, e.g. by pressing or squeezing the first flange and the second flange against each other.

The metal wall and the metal bottom plate may alternatively or additionally be locked in the cavity by welding.

In an embodiment of the present invention the recess of the metal profile (and the metal frame) may be directed towards the centre of the metal-box. In a further embodiment of the present invention the recess may preferably be placed on the opposite site of the metal bottom plate relative to the metal wall.

Preferably, the recess of the metal frame (i.e. the opening of the recess) may be directed towards the centre of the metal-box and the recess may preferably be placed on the opposite site of the metal bottom plate relative to the metal wall. Preferably, the recess of the metal frame (i.e. the opening of the recess) may be directed substantially in parallel direction relative to the metal bottom plate.

The opening of the recess and/or the bottom edge of the recess may be in parallel to, or substantially in parallel to, the longitudinal direction of the metal bottom plate.

In an embodiment of the present invention the metal box, such as the aluminium box, may be provided with a metal lid. The metal lid may preferably be pivotable attached to the metal box, by introducing one or more hinges which are attached to the metal wall and to the metal lid using one or more rivets. The metal lid may be made from the same metal material as used for making the metal profile.

In a further embodiment of the present invention a handle may be mounted on the metal wall. Preferably the metal wall may be attached to the metal wall by introducing one or more rivet.

The handle may comprise a handle as such and a mounting plate. in addition to the metal material of the handle, the handle as such may further comprise a plastic element or a wooden element in the area where the handle is held by the hand in order to improve contact.

In an embodiment of the present invention the henges and/or the handle and/or the rivets may comprise the same metal material as the metal profile or a different metal material than used in the metal profile.

In a further embodiment of the present invention the henges and/or the handle and/or the rivets may comprise stainless steel.

In the present context the rivet may be a permanent mechanical fastener. Before being installed, the rivet may comprise a smooth cylindrical shaft with a head on one end. The end opposite to the head may be called the tail. On installation, the rivet may be placed in a punched or drilled hole, and the tall is upset, or bucked (i.e., deformed), so that it expands to about 1.5 times the original shaft diameter, holding the rivet in place.

The metal material used in the metal profile may preferably be aluminum. Preferably, the metal material used in the metal profile and in the metal wall may preferably be aluminum. Preferably, the metal material used in the metal profile, in the metal wall and in the metal bottom plate may preferably be aluminum. Preferably, the metal material used in the metal profile, in the metal wall, in the metal bottom plate, and in the metal lid may preferably be aluminum.

Preferably, the metal material used in the hinges, the handle and/or the rivets may preferably be aluminum or stainless steel.

In the context of the present invention the term "substantially" relates to a variation of at the most 10% deviation from the stated feature; such as a deviation of at the most 8%; e.g. a deviation of at the most 6%; such as a deviation of at the most 4%; e.g. a deviation of at the most 2%; such as a deviation of at the most 1%.

It should be noted that embodiments and features described in the context of one of the aspects of the present invention also apply to the other aspects of the invention.

REFERENCES (1): Metal profile
(2): Elongated element
(3): Cross-section
(4): Cavity
(5): First flange
(6): Bottom part
(7): Second flange
(8): First side of the second flange
(9): Recess
(10): Second side of second flange
(11): Protrusion
(12): Metal bottom plate
(13): Metal wall
(14): Metal-box
(15): Metal frame
(16): Second part of a coupling system
(17*a*): Bottom edge of the recess
(17*b*): top edge of the recess
(18): Opening of the recess
(19*a*): Handle
(19*b*): Mounting plate
(20): Lock
(21): Lid
(22): First side of first flange
(23): Second side of first flange
(24): Coupling system (25): Bracket
(26): Mounting hole

The invention claimed is:

1. A metal-box (14) comprising a metal frame (15), at least one metal wall (13) and at least one metal bottom plate (12), wherein the metal frame (15) comprises a metal profile (1), wherein the metal profile (1) comprising an elongated element (2) and a cross-section (3), wherein the cross-section (3) comprising:

(i) a cavity (4), and the cavity (4) is enclosed by a first flange (5), a bottom part (6) and a first side (8) of a second flange (7), and (ii) a recess (9) enclosed by a second side (10) of the second flange (7) and the bottom part (6), wherein the first flange (5) is curved or partly curved towards the second flange (7) and/or wherein the first side (8) of the second flange (7) is curved or partly curved towards the second side (10) of the second flange (7), wherein the recess (9) is capable of coupling with one or more second parts (16/25) of a coupling system (24), and wherein the at least one metal wall (13) and the at least one metal bottom plate (12) are combined in the cavity (4) of the cross section (3) of the metal profile (1).

2. The metal-box (14) according to claim 1, wherein the metal profile is provided from a metal material, wherein the metal material is aluminium.

3. The metal-box (14) according to claim 1, wherein the cavity (4) is provided for receiving two or more metal plates to be combined.

4. The metal-box (14) according to claim 3, wherein the two or more metal plates are aluminium plates.

5. The metal-box (14) according to claim 1, wherein the second side (10) of the second flange (7) is provided with a protrusion (11).

6. The metal-box (14) according to claim 1, wherein a second part (16) of a coupling system engages with a recess (9) of the metal frame (15), the second part (16) of the coupling system engages with the bottom edge (17*a*) of the recess (9).

7. The metal-box (14) according to claim 1, wherein the recess (9) of the metal frame (15) has the opening (18) of the recess (9) directed towards the centre of the metal-box (15).

8. The metal-box (14) according to claim 1, wherein the recess (9) is placed on an opposite side of the metal bottom plate (12) relative to the metal wall (13).

9. The metal-box (14) according to claim 1, wherein the recess (9) is provided to engage with one or more brackets (25).

* * * * *